US011781354B2

(12) United States Patent
Baker et al.

(10) Patent No.: US 11,781,354 B2
(45) Date of Patent: Oct. 10, 2023

(54) PATCH FITTING COVERPLATE

(71) Applicant: ASSA ABLOY Accessories and Door Controls Group, Inc., New Haven, CT (US)

(72) Inventors: Vincent Baker, Rockwood, PA (US); Matthew Donaldson, Meyersdale, PA (US)

(73) Assignee: ASSA ABLOY Accessories and Door Controls Group, Inc., New Haven, CT (US)

( * ) Notice: Subject to any disclaimer, the term of this patent is extended or adjusted under 35 U.S.C. 154(b) by 0 days.

(21) Appl. No.: 17/533,343

(22) Filed: Nov. 23, 2021

(65) Prior Publication Data

US 2022/0178185 A1 Jun. 9, 2022

Related U.S. Application Data

(60) Provisional application No. 63/121,282, filed on Dec. 4, 2020.

(51) Int. Cl.
*E05D 11/00* (2006.01)
*E05D 3/02* (2006.01)
(Continued)

(52) U.S. Cl.
CPC ..... *E05D 11/0054* (2013.01); *E05D 3/02* (2013.01); *E05D 5/0246* (2013.01); *E05F 5/02* (2013.01);
(Continued)

(58) Field of Classification Search
CPC ..... E05D 11/0054; E05Y 2800/70; E05Y 2201/11; E05Y 2900/132
See application file for complete search history.

(56) References Cited

U.S. PATENT DOCUMENTS

D12,974 S 6/1882 Thomas
4,956,954 A * 9/1990 Horgan, Jr. ..... E05F 3/227 52/745.16
(Continued)

FOREIGN PATENT DOCUMENTS

GB 1 093 512 A 12/1967
GB 1093513 A * 12/1967 ..... E05D 7/00
(Continued)

OTHER PUBLICATIONS

[No Author Listed] CRL Glass Entrance System Door Rails. C. R. Laurence Company. https://dkhstatic.blob.core.windows.net/products/5395/catalogs/AH11-091114_26.pdf, 2017, 1 page.
(Continued)

*Primary Examiner* — Jason W San
(74) *Attorney, Agent, or Firm* — Wolf, Greenfield & Sacks, P.C.

(57) ABSTRACT

A patch fitting coverplate or cap for a patch fitting that extends a pivot point centerline of the patch fitting. The patch fitting coverplate may be constructed as a retrofit cover to integrate a patch fitting of one standard pivot point centerline to a door pane of another standard pivot point centerline. A patch fitting assembly including the patch fitting coverplate and patch fitting may also include buffers to fill in the interior portion between the extended patch fitting coverplate and the patch fitting. The patch fitting may be tapered at an edge close to the pivot axis of the door pane for smooth actuation of the door pane.

9 Claims, 8 Drawing Sheets

(51) Int. Cl.
*E05D 5/02* (2006.01)
*E05F 5/02* (2006.01)

(52) U.S. Cl.
CPC ..... *E05Y 2201/11* (2013.01); *E05Y 2800/70* (2013.01); *E05Y 2900/132* (2013.01)

(56) References Cited

U.S. PATENT DOCUMENTS

D313,170 S 12/1990 Nye
D411,441 S 6/1999 Bouquot et al.
D421,147 S 2/2000 Herst et al.
6,070,294 A * 6/2000 Perkins ..... E05D 5/0246 16/334
6,519,811 B1 2/2003 Cheng
6,609,350 B1 * 8/2003 Weber ..... E06B 3/5454 52/784.1
6,766,561 B1 7/2004 Cheng
D503,058 S 3/2005 Loewenthal
6,912,818 B2 7/2005 Sprague
D535,035 S 1/2007 Ohanesian
7,188,390 B2 * 3/2007 Cheng ..... E05D 5/0246 16/241
7,305,797 B2 12/2007 Chiang
7,328,482 B2 * 2/2008 Elmer ..... E05D 7/081 16/253
7,673,373 B2 3/2010 Chang et al.
D644,784 S 9/2011 Monteix et al.
D668,930 S 10/2012 Tien
8,528,169 B1 * 9/2013 Yu ..... E05F 3/20 16/238
8,578,557 B2 11/2013 Yu
8,789,240 B2 * 7/2014 Bouwman ..... E05F 1/1253 16/334
D753,412 S 4/2016 Anderson
9,834,968 B2 * 12/2017 Whitaker ..... E05D 11/06
9,879,456 B1 * 1/2018 Chen ..... E05D 5/0246
D867,123 S 11/2019 Griswold
D874,024 S 1/2020 Griswold
10,829,971 B2 11/2020 Murray et al.
11,304,817 B2 * 4/2022 Altarac ..... A61F 2/447
11,484,159 B2 * 11/2022 Lin ..... F16H 1/06
2002/0100234 A1 * 8/2002 Sprague ..... E06B 3/5454 52/800.14
2003/0233731 A1 * 12/2003 Cotton ..... E05D 11/0054 16/250
2004/0129167 A1 * 7/2004 Sprague ..... E06B 3/02 104/89
2007/0119108 A1 5/2007 Downard
2007/0193148 A1 8/2007 Simko et al.
2007/0228742 A1 * 10/2007 Chiang ..... E05D 5/0246 292/163
2008/0093520 A1 * 4/2008 Chang ..... E05F 3/227 248/226.11
2013/0160238 A1 * 6/2013 Cheng ..... E05D 5/0246 16/54
2013/0185896 A1 * 7/2013 Yu ..... E05F 3/104 16/55
2014/0352108 A1 * 12/2014 Cheng ..... E05F 3/104 16/54
2015/0272397 A1 * 10/2015 Wei ..... E05D 11/0054 4/614
2015/0368951 A1 * 12/2015 Wang ..... E05D 5/0246 16/64
2018/0327986 A1 11/2018 Cook
2019/0226256 A1 * 7/2019 Murray ..... E05D 7/081
2019/0234134 A1 * 8/2019 Thompson ..... E06B 3/36
2019/0284858 A1 * 9/2019 Bacchetti ..... E05D 11/08
2019/0390493 A1 * 12/2019 Bacchetti ..... E05D 5/0246
2020/0308900 A1 * 10/2020 Choi ..... E06B 3/605
2021/0127832 A1 * 5/2021 Shahzad ..... A47B 97/00
2021/0285271 A1 * 9/2021 Windmann ..... E05D 11/0054
2021/0369057 A1 * 12/2021 Lin ..... F16H 57/02
2022/0106820 A1 * 4/2022 Shabaan ..... E05D 7/04
2022/0235591 A1 * 7/2022 Jarvis ..... E05D 5/0246
2022/0307302 A1 * 9/2022 Folie ..... E05D 5/0276
2022/0316266 A1 * 10/2022 Kao ..... E06B 3/02

FOREIGN PATENT DOCUMENTS

JP D1087350 S 10/2000
JP D1448452 S 8/2012
WO WO 2005/007981 A2 1/2005

OTHER PUBLICATIONS

[No Author Listed] Door Rails. ASSA ABLOY. https://www.assaabloyglass.us/en/local/assaabloyglassus/products/door-rails/, 2017, 2 pages.
[No Author Listed] DRS Rail System—With Sidelites. Dorma. https://www.dormakaba.com/resource/blob/194758/00a5abed79a09d07271065e567485ff7/934804-ins-drs-rail-sl-0416-pdf-data.pdf, 2016, 8 pages.
[No Author Listed] Glass Solutions 2017 Price List Brought to You by ASSA ABLOY. ASSA ABLOY. https://accesshardware.com/wp-content/uploads/2017/07/Assa-Abloy-Glass-Solutions-Price-Book.pdf, 2017, 34 pages.
[No Author Listed] Glass Solutions Brought to You By ASSA ABLOY. ASSA ABLOY. https://www.assaabloylibrary.us/glasssolutions/ASSA-ABLOY-Glass-Solutions-Full-Line-Catalog/1/, 2017, 74 pages.
[No Author Listed] Product Listing for CRL Brushed Stainless Anodized End Cap for 4" Tapered 1/2" Glass Wedge-Lock Door Rail by CR Laurence. Amazon.com. https://www.amazon.com/Brushed-Stainless-Anodized-Wedge-Lock-Laurence/dp/B0064OWFWM, 2012, 4 pages.

* cited by examiner

PATCH FITTING COVERPLATE

RELATED APPLICATIONS

This application claims the benefit under 35 U.S.C. § 119(e) to U.S. Provisional Application Ser. No. 63/121,282, entitled "Patch Fitting Coverplate", filed on Dec. 4, 2020, which is herein incorporated by reference in its entirety.

FIELD

Disclosed embodiments are related to coverplates for patch fittings for glass doors.

BACKGROUND

Patch fitting are conventionally used to hold plate glass door panes (or other transparent, translucent, or opaque panels) in a doorway opening or for use as a wall partition and may be used to control the closing and latching speed of the glass door panes. Usually, the patch fitting runs along a portion of one or more edges of the glass door pane and secures the pane to a pivot point.

SUMMARY

In one embodiment of the patch fitting coverplate, the patch fitting coverplate is operatively couplable to a door pane associated with a door frame. The patch fitting coverplate comprises a body constructed and arranged to cover and external portion of the patch fitting. In this embodiment, the body comprises a tapered edge tapered relative to a horizontal axis of the door pane and a leading edge extending from the tapered edge in a direction towards a midplane of the door pane when the door pane is coupled to the patch fitting.

In another embodiment of the patch fitting coverplate, the patch fitting coverplate is operatively couplable to a door pane and a pre-existing coverplate having leading edge spaced away from a spindle extending from the pre-existing patch fitting by a first distance. The patch fitting coverplate comprises a body constructed and arranged to cover a portion of the pre-existing patch fitting. In this embodiment, the patch fitting coverplate includes a leading edge configured to be spaced away from the spindle extending from the pre-existing patch fitting by a second distance, wherein the second distance is greater than the first distance.

In yet another embodiment of the patch fitting coverplate, the patch fitting coverplate is operatively couplable to a door pane. The patch fitting coverplate comprises a body constructed and arranged to cover an external portion of the pre-existing patch fitting and one or more buffers cooperating with the body. In this embodiment, the body is operatively couplable to the pre-existing door patch through a friction fitting with the one or more buffers.

In yet another embodiment of the patch fitting coverplate, the patch fitting coverplate is operatively couplable to a door pane and a pre-existing coverplate having leading edge spaced away from a spindle extending from the pre-existing patch fitting by a first distance. The patch fitting coverplate comprises a body constructed and arranged to cover a portion of the pre-existing patch fitting. In this embodiment, the body comprises a tapered edge tapered relative to a horizontal axis of the door pane and a leading edge extending from the tapered edge in a direction towards a midplane of the door pane when the door pane is coupled to the patch fitting. In this embodiment, the leading edge of the body is configured to be spaced away from the spindle extending from the pre-existing patch fitting by a second distance, wherein the second distance is greater than the first distance. In this embodiment, the body is operatively couplable to the pre-existing door patch through a friction fitting with the one or more buffers.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
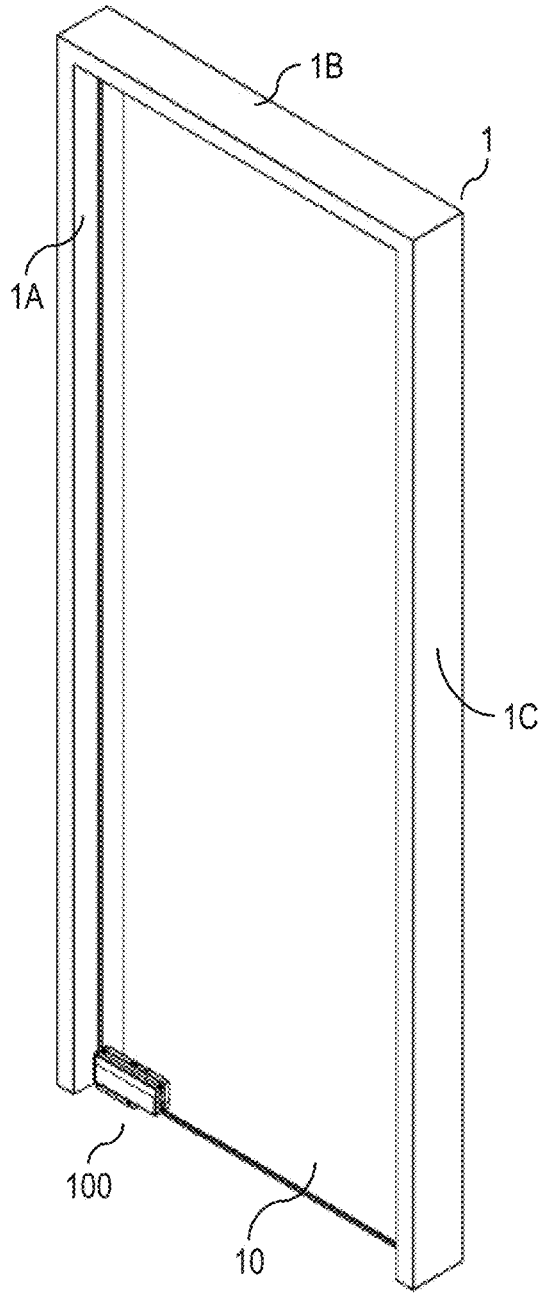
FIG. 1A is a perspective top view of one embodiment of a patch fitting assembly installed on a glass door.

In order to install a glass door, a glass door pane is conventionally clamped between two plates. In some cases, the plates are formed as a part of a patch fitting assembly, which secures the glass door pane to a pivot point or other operable mechanisms and enables actuation of the glass door pane around a pivot axis. The patch fitting assembly typically includes a complex and costly patch fitting, which may include hydraulic controls for controlling/dampening (e.g., closing, latching) speeds of the glass door pane. A typical standard distance between the pivot axis of the patch fitting assembly installed on the glass door pane and a proximal portion of the door frame is 2¾ inches, whereas another typical standard distance between the pivot point and a proximal portion of the door frame is 2⁹⁄₁₆ inches. Due to the discrepancy of the pivot point centerline standards, it may be challenging to interface a patch fitting of one standard with a glass door pane of another standard.

In view of the above, the inventors have recognized the benefits of a coverplate that may be fit over a patch fitting to modify the pivot point centerline between the patch fitting and a door frame, without requiring any changes to the patch fitting geometry, which may be costly and complex. The coverplate may act to retrofit existing patch fittings with any pivot point centerline to interact with glass door panes and floor plates of any other standard pivot point centerline.

According to some embodiments of the present disclosure, a patch fitting assembly may be installed at the pivot point of a glass door pane to enable controllable actuation of the glass door pane. The patch fitting assembly may be installed between the glass door pane and the floor underneath the glass door pane, connected through a floor plate installed directly on the floor. When the glass door pane is actuated, the patch fitting may rotate around a pivot point on the floor plate, while the floor plate remains stationary with respect to the glass door pane. A vertical axis of the glass door pane passing through the patch fitting assembly may be known as a pivot axis, around which a portion of the patch fitting assembly and the glass door pane rotate.

In other embodiments, the patch fitting assembly may be installed between the glass door pane and the upper portion of the door frame, which may surround the glass door pane, directly above the patch fitting assembly installed on the floor. The axis between the patch fitting assembly installed on the floor and the patch fitting assembly installed on the frame may create a pivot axis, around which a portion of the patch fitting assembly and the glass door pane rotate.

In some embodiments, the patch fitting assembly may include a pair of coverplates covering opposite sides of a patch fitting, which may hold a glass door pane, buffers between the coverplates and the patch fitting, a floor plate attaching the assembly to the floor, and covers for the floor plate.

The patch fitting may include a largely geometric body with a spindle extending down from the lower portion of its body, which may interact with a recess in the floor plate as described in detail below. The patch fitting may be a hydraulic patch fitting with controls to adjust closing speed of the glass door pane and to latch the glass door pane after opening to a particular angle. These controls may enable safe, quiet, and reliable operation of the glass door pane, which may typically be heavy and prone to fracture.

In some embodiments, the patch fitting may further include a channel across the top-most portion of the patch fitting to seat a portion of the glass door. In some embodiments, the channel may be sized to suitably fit a standard or non-standard glass door pane within the channel. The surface of the channel may include material to enhance the friction between the glass door pane and the patch fitting such that the glass door pane remains stationary relative to the patch fitting. The frictional interaction between the glass door pane and the patch fitting may reduce dislocation of the glass door pane during normal operation of the glass door, wherein a user may push or pull the glass door pane at a location distal form the patch fitting, where the moment arm between the applied force and the patch fitting may be substantial.

In these embodiments, the pair of coverplates may be situated on opposing sides of the glass door pane, each covering a different portion of the patch fitting. In some embodiments, the pair of coverplates may be mirrored across the plane of the glass door pane, such that there may be a first coverplate and a second coverplate with mirrored features. The coverplates may include a planar face that may be substantially parallel with an associated glass door pane, and edges extending out of plane from the coverplate face towards the glass door to substantially cap (i.e. cover) either the patch fitting and/or a corner of the glass door pane. The coverplates may protect the patch fitting, which may have complex geometry, from potential damage and debris, and may extend the life of the patch fitting. The coverplates may also add aesthetic value to the patch fitting assembly, presenting a smooth and planar face to the patch fitting without revealing the underlying complexities of the patch fitting. In some embodiments, the coverplates may be removably attached to the patch fitting for ease of installation, but may remain stationary relative to the patch fitting during normal operation. Accordingly, during normal use, the coverplates may resist external force, and may even serve as a push surface by which an associated glass door may be normally operated (i.e., pushed open or closed). In some embodiments, when the coverplates are installed on the patch fitting, the coverplates remain stationary with respect to the patch fitting, the glass door pane, and the buffer. The coverplates may be any suitable shape, such as a square or a rounded shape, as the present disclosure is not so limited.

In some embodiments, the coverplates may include a tapered edge which may cover the back edge of the glass door pane. In these embodiments, the tapered edge may be situated between a proximal portion of the door frame and the glass door pane. In these embodiments, the coverplates enable smooth actuation of the glass door, and reduce potential collisions between the patch fitting assembly and the glass door pane when the glass door pane is actuated. The tapered edge may be characterized by a taper angle measured between the plane of the tapered edge and a plane normal to the glass door pane. In some embodiments, the taper angle may be between 12° and 16°, for example 15.6°. The tapered edge may have any suitable shape, including, but not limited to, a substantially curved shape as the present disclosure is not so limited. In some embodiments, the geometry of the tapered edge may also enable integration of the coverplates with door rail end caps of similar geometries.

In some embodiments, the tapered edge may be accompanied by a leading edge extending from the tapered edge in the direction towards the glass door pane. The leading edge may provide aesthetic benefits of capping the portion of the patch fitting closest to the proximal portion of the door frame. The leading edge may only be present on one end of the patch fitting, where the glass pane is closest to the proximal portion of the door frame. The tapered edge and the leading edge may be different heights, which may allow the glass pane to extend out beyond the patch fitting assembly, closer to the proximal portion of the door frame. In some embodiments, the leading edge may be orthogonal to the coverplate face, such that a lead angle measured between the plane of the coverplate and the plane of the leading edge may be 90°. In other embodiments, it may be preferable for the leading edge to be tapered akin to the tapered edge for aesthetic purposes or to maximize the clearance between the patch fitting assembly and the glass door pane.

In some embodiments, the bottom face of the coverplates may include recesses to accommodate the extended spindle of the patch fitting. These recesses may be suitably sized to allow the extended spindle to engage with the floor plate without limiting the functionality of the spindle. In some embodiments, the recesses may be larger than the spindle to allow variable adjustment of the spindle location with respect to the coverplates. The recesses may be measured by a recess depth, measured as the distance the recess extends normal to the plane of the coverplate face, a recess width, measured as the distance between the edges of the recess at the plane of the glass door, and a recess inner width, measured as the distance between the edges of the recess at the recess depth. In some embodiments, the recess inner width may be the same size as the recess width. In other embodiments, it may be suitable for the recess to include a taper between the recess inner width and the recess width for relief of stress concentrations. The recesses may be arranged with any suitable shape to accept the spindle, including a semi-ellipse or a semi-octagon, as the current disclosure is not so limited. In embodiments where the coverplates are a pair of mirrored coverplates, the recesses may also be mirrored on each of the pair of mirrored coverplates. In other embodiments, the recesses may not be mirrored and each of the pair of mirrored coverplates may include a different recess geometry to accommodate the spindle, as the present disclosure is not so limited.

In some embodiments, the coverplates may include an added functionality of changing the pivot point centerline of the patch fitting assembly. In all embodiments, the pivot point centerline is measured as the distance between the central axis of the spindle of the patch fitting and the proximal portion of the door frame. In some embodiments, the coverplates may extend the pivot point centerline of a patch fitting from 2 9/16 inches to 2¾ inches. In these embodiments, the coverplates extend beyond the patch fitting in a direction towards the proximal portion of the door frame. The extension of the coverplate with respect to the patch fitting with a pivot point centerline of 2 9/16 inches may enable the patch fitting to be integrated with glass door panes designed with a pivot point centerline of 2¾ inches. In some embodiments, it may be suitable for the coverplates to extend the pivot point centerline to a distance between 2 9/16 inches and 2¾ inches. In some embodiments, the pivot point centerline of the patch fitting assembly may be 2¾ inches.

In all embodiments, the length of the coverplate is measured from the leading edge to the opposite side of the coverplate. In embodiments where the coverplate extends the pivot point centerline of a patch fitting from 2 9/16 inches to 2¾ inches, the length of the coverplate may be between 7 and 8 inches, for example 7.5 inches.

In embodiments where the coverplates extend beyond the patch fitting, the patch fitting assembly may include buffers. The buffers may be disposed on an interior portion of the coverplates between the glass door pane and the patch fitting. The buffers may separate the coverplates from the glass door to avoid undesirable contact or potential damage. In some embodiments, the buffers may provide rigid structural support to the portions of the coverplates not directly covering the patch fitting. For example, if the portion of a coverplate which extends beyond the patch fitting experiences an impact force (e.g. a kick), the buffers may potentially protect the coverplate from potential indentation or damage. In some embodiments, the buffers may be constructed and arranged with a shock absorbing material (e.g., rubber, silicone, foam, polyether plastics, etc.) such that any external force applied to the coverplates is damped and distributed evenly to the glass door pane. In other embodiments, the buffers may include internal geometry (e.g. honeycomb) to enhance the shock absorbance or rigidity while minimizing weight of the patch fitting assembly.

In some embodiments, the buffers may be arranged to enhance the friction between multiple surfaces. In these embodiments, the buffers may be composed of a friction-enhancing material (e.g., rubber, silicone, cork, cellulose-based composites). In some embodiments, the buffers may enhance the friction between the glass door pane and the coverplates, and/or the friction between the patch fitting and the coverplates. As described earlier, during normal operation, a user may push or pull the glass door pane at a location distal form the patch fitting assembly, the moment arm between the applied force and the patch fitting may be substantial. The frictional interaction between the patch fitting and the glass door panes (through the buffer), and/or the frictional interaction between patch fitting and the coverplates (through the buffer) may potentially prevent dislocation of the glass door pane during normal operation. In some embodiments, the frictional properties of the buffers may allow the coverplates to be reliably installed onto the patch fitting using a friction fit, without the need for complex mechanical fasteners.

In some embodiments, the buffers may be a pair of buffers, each of the pair of geometric buffers arranged between the patch fitting, the coverplates, and the glass door pane. In these embodiments, every face of the buffer may interface with a surface of either the patch fitting, the coverplates, or the glass door pane. Accordingly, the buffers may frictionally couple the patch fitting, the coverplates, and the glass door pane. In some embodiments, the pair of buffers may be mirrored akin to an embodiment of mirrored coverplates. In other embodiments, a pair of mirrored buffers may interface with a pair of non-mirrored coverplates, a pair of non-mirrored buffers may interface with a pair of mirrored coverplates, or any other suitable combination as the present disclosure is not so limited.

In some embodiments, the buffers may be attached to the coverplate using adhesives or a fastening means. In other embodiments, the buffers may be attached to the patch fitting using adhesives or a fastening mechanism. In some embodiments, there may be sufficient friction between the buffers and neighboring interfaces (e.g. patch fitting, coverplate, glass door pane) that the buffers need not be adhesively attached to the coverplate. In other embodiments, a combination of adhesive attachment and a fastening means (e.g. screws, bolts, nails, rivets) may be used to attach the coverplate to the buffers.

In some embodiments, the patch fitting assembly may include a floor plate and associated covers. The floor plate may be configured to be installed on the floor directly under the patch fitting, and remain stationary with respect to the floor anytime the glass door pane is actuated. The floor plate may interact with the patch fitting by inserting the spindle extending from the bottom face of the patch fitting into a recess of the floor plate. The spindle may be fixed relative to the floor plate when the patch fitting (and glass door pane) is rotated around the spindle. The insertion of the spindle into the floor plate may distribute the weight of the patch fitting on the floor plate and reduce displacement of the patch fitting with respect to the floor plate.

In some embodiments, the floor plate may be shorter than the patch fitting in the direction parallel to the door. In these embodiments, there may be a portion of the patch fitting assembly, and a substantial portion of the glass door pane edge, that may be suspended and offset from the floor by an offset distance. The offset distance may be measured between the bottom edge of the coverplates and the floor. The offset distance may be sufficiently large to reduce accumulation of dust or debris at the edge of the glass door pane, by sweeping the floor any time the glass door is operated. The offset distance may also be sufficiently small to reduce substantial air flow from one side of the glass door to the other side of the glass door. In some embodiments, the offset distance may be suitably small to reduce substantial acoustic noise transfer from one side of the glass door to the other side of the glass door.

In some embodiments, the floor plate may include floor plate covers to protect the floor plate, which may have complex geometry and topography, from damage and debris, and may extend the life of the floor plate. The floor plate covers may also add aesthetic value to the patch fitting assembly, presenting a smooth and planar face to the floor plate without revealing the underlying complexities of the floor plate.

In some embodiments, when the patch fitting assembly is installed on the glass door pane and the floor, a first gap between the glass door pane and the proximal portion of the door frame may be suitably arranged to allow smooth operation of the glass door (e.g. swinging open and close) without potential collision of the glass door pane and the proximal portion of the door frame. In some embodiments, the first gap may be suitably small to restrict substantial air flow from one side of the glass door to the other side of the glass door through the first gap. In some embodiments, the first gap may be suitably small to reduce substantial acoustic noise transfer from one side of the glass door to the other side of the glass door. In one example, the glass door and patch fitting assembly may be used for a conference room wherein private meetings may be conducted, necessitating that the glass door transmit a minimal amount of the noise from the conference room to nearby areas. In embodiments where the coverplates extend the pivot point centerline of the patch fitting from 2 9/16 inches to 2 3/4 inches, the first gap may be 1/8 inch.

In some embodiments, when the patch fitting assembly is installed on the glass door pane and the floor, a second gap between the leading edge of the coverplates and the proximal portion of the door frame may be suitably arranged to allow smooth operation of the glass door (e.g. swinging open and close) without potential collision of the glass door pane and the proximal portion of the door frame. In some embodiments, the second gap may be suitably small to reduce transmission of air or noise from one side of the glass door to the other side of the glass door, as described previously. In some embodiments, the second gap may be larger than the first gap. In these embodiments, the difference in height between the tapered edge and the leading edge of the coverplates may allow the glass pane to extend out beyond the patch fitting assembly, closer to the proximal portion of the door frame. In these embodiments, the glass door pane may include a chamfer for smooth rotation of the glass door pane against the proximal portion of the door frame during normal operation. In embodiments where the coverplates extend the pivot point centerline of the patch fitting from 2 9/16 inches to 2 3/4 inches, the second gap may be 13/32 inch.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein. For example, while all the embodiments described herein refer to coverplates for a hydraulic patch fitting, the coverplates may be configured for any suitable patch fitting, as the present disclosure is not so limited. In another example, while all the embodiments described herein refer to a glass door pane, the door pane on which the patch fitting is installed may be any suitable mater, as the present disclosure is not so limited.

FIG. 1A depicts one embodiment of the patch fitting assembly 100 installed on a glass door pane 10 within a door frame 1, including a proximal portion 1A, an upper portion 1B, and a distal portion 1C. Although FIG. 1A shows the patch fitting assembly installed on a lower portion of the door 10, it may also be suitable to install a complementary patch fitting assembly at an upper portion of the door 10, at the upper portion of the door frame 1. In the example shown in FIG. 1A, the door 10 is in a closed configuration, wherein the plane of the door 10 is contained within the door frame 1. In another example shown in FIG. 1B, the glass door pane 10 may be in an operative mode, wherein it is rotated around a pivot axis. In this example, portions of the patch fitting assembly 100 remain stationary to the glass door pane 10, and portions of the patch fitting assembly 100, namely the floor plate 130, remain stationary to the floor.

Figure 2:
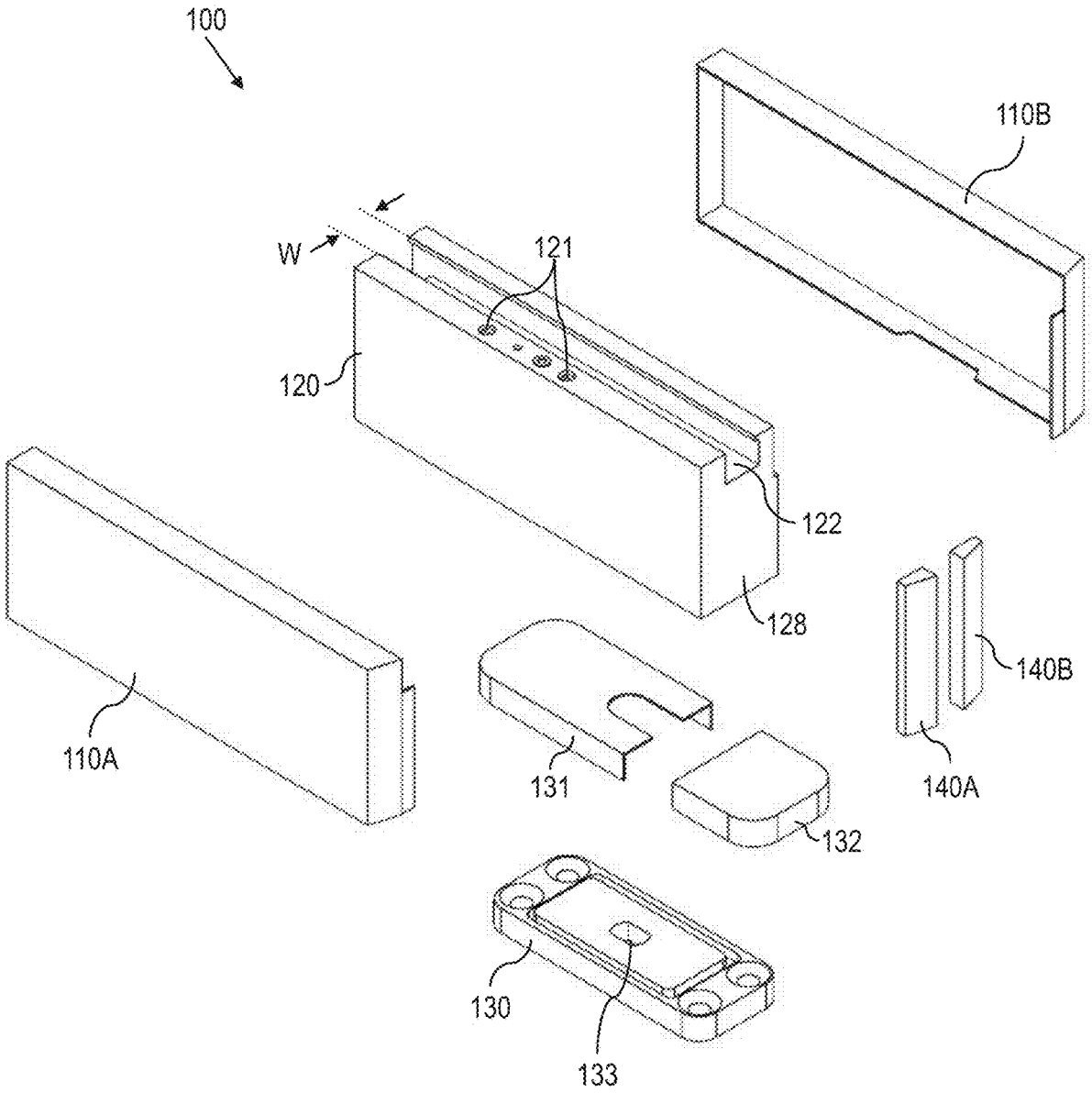
FIG. 2 is an exploded perspective view of an embodiment of the patch fitting assembly.

FIG. 2 depicts an exploded view of an embodiment of a patch fitting assembly 100. The patch fitting assembly includes a patch fitting 120, a pair of coverplates 110A, 110B, a floor plate 130, and buffers 140A, 140B.

In this embodiment, the patch fitting 120 is a hydraulic patch fitting with controls 121 that may, for example, adjust the closing speed of the glass door pane or the latch angle of the patch fitting 120. These controls may include set screws or any other suitable adjustment mechanism, as the present disclosure is not so limited, to adjust the closing speed of the door. Furthermore, the patch fitting 120 includes a channel 122 across the top portion of the patch fitting 120. In the depicted embodiment, the channel 122 is suited to receive a portion of the bottom edge of a glass door pane 10. In some embodiments, the interior surface of the channel 122 may include material to enhance the friction between the glass door pane 10 inserted in the channel 122 and the patch fitting 120 such that the glass door pane remains stationary relative to the patch fitting. In other embodiments, the channel 122 may include a separate insert arranged as a friction enhancing material (e.g., rubber, silicone, cork, cellulose-based composites), as the present disclosure is not so limited.

In some embodiments, the channel 122 may be characterized by a width W measured across the channel 122. In these embodiments, a glass door pane 10 with a suitable width similar to W, with suitable tolerancing, may be seated in the channel 122. In some embodiments, W may be between 3/8 inch and 1/2 inch, for example 3/8 inch or 1/2 inch.

In the embodiment depicted in FIG. 2, the patch fitting assembly 100 includes a pair of coverplates 110A, 110B, which can be installed on opposing sides of the glass door pane 10. In this embodiment, the coverplates 110A, 110B are mirrored, such that the pair of coverplates includes a first coverplate 110A and a second coverplate 110B with mirrored features as depicted in FIG. 2. In some embodiments, the coverplates 110A, 110B may include a planar face that may be substantially parallel with an associated glass door pane 10, and edges extending out of plane from the coverplate 110A, 110B face to substantially cap (i.e. cover) either the patch fitting and/or a corner of the glass door pane. Although the edges of the coverplates 110A, 110B are depicted as orthogonal to the coverplate 110A, 110B face, in some embodiments, any combination of the edges may be tapered for aesthetic or functional purposes. While the coverplates 110A, 110B in FIG. 2 are depicted as a pair, a single coverplate assembly, connected through the bottom portion of the glass door pane 10, or any other configuration of the coverplates 110A, 110B may be used, as the present disclosure is not so limited.

In the embodiment depicted in FIG. 2, the patch fitting assembly 100 further includes a floor plate 130 and associated covers 131,132. The floor plate 130 is configured to be installed on the floor directly under the patch fitting 120, and remain stationary with respect to the floor anytime the glass door pane 10 is actuated. In some embodiments, the floor plate 130 may interact with the patch fitting by inserting a spindle 125 (see FIG. 3B) extending from the bottom face of the patch fitting into a recess 133 of the floor plate 130. The spindle 125 may be fixed relative to the floor plate 130 when the patch fitting 120 (and glass door pane 10) is rotated around the spindle. The insertion of the spindle 125 into the floor plate 130 may distribute the weight of the patch fitting 120 on the floor plate 130 and reduce displacement of the patch fitting 120 with respect to the floor plate 130.

The floor plate covers 131, 132 may be installed on the upper portion of the floor plate 130 once the floor plate 130 has been adjusted. In other embodiments, the covers 131, 132 may be installed on the upper portion of the floor plate 130 after the patch fitting 120 has been installed on the floor plate 130, as the present disclosure is not so limited. In some embodiments, the covers 131, 132 may protect the floor plate 130 from debris or damage, and may add aesthetic value to the patch fitting assembly.

The patch fitting assembly 100 shown in FIG. 2 may further include buffers 140A, 140B. The buffers 140A, 140B may be installed between the interior portion of the coverplates 110A, 110B and the patch fitting 120 as discussed below. Although the buffers 140A, 140B are depicted as a pair of mirrored, solid, polygonal bodies, any suitable geometry for the buffers 140A, 140B may be used, as the present disclosure is not so limited. For example, the buffers may include a single body spanning both sides of the coverplates 110A, 110B. In other embodiments, the buffers 140A, 140B may be perforated or include internal architecture (e.g. honeycomb) for shock absorbing benefits. As described below, the buffers 140A, 140B may be arranged to enhance the friction between multiple surfaces. In these embodiments, the buffers may be composed of a friction-enhancing material (e.g., rubber, silicone, cork, cellulose-based composites).

Figure 3:
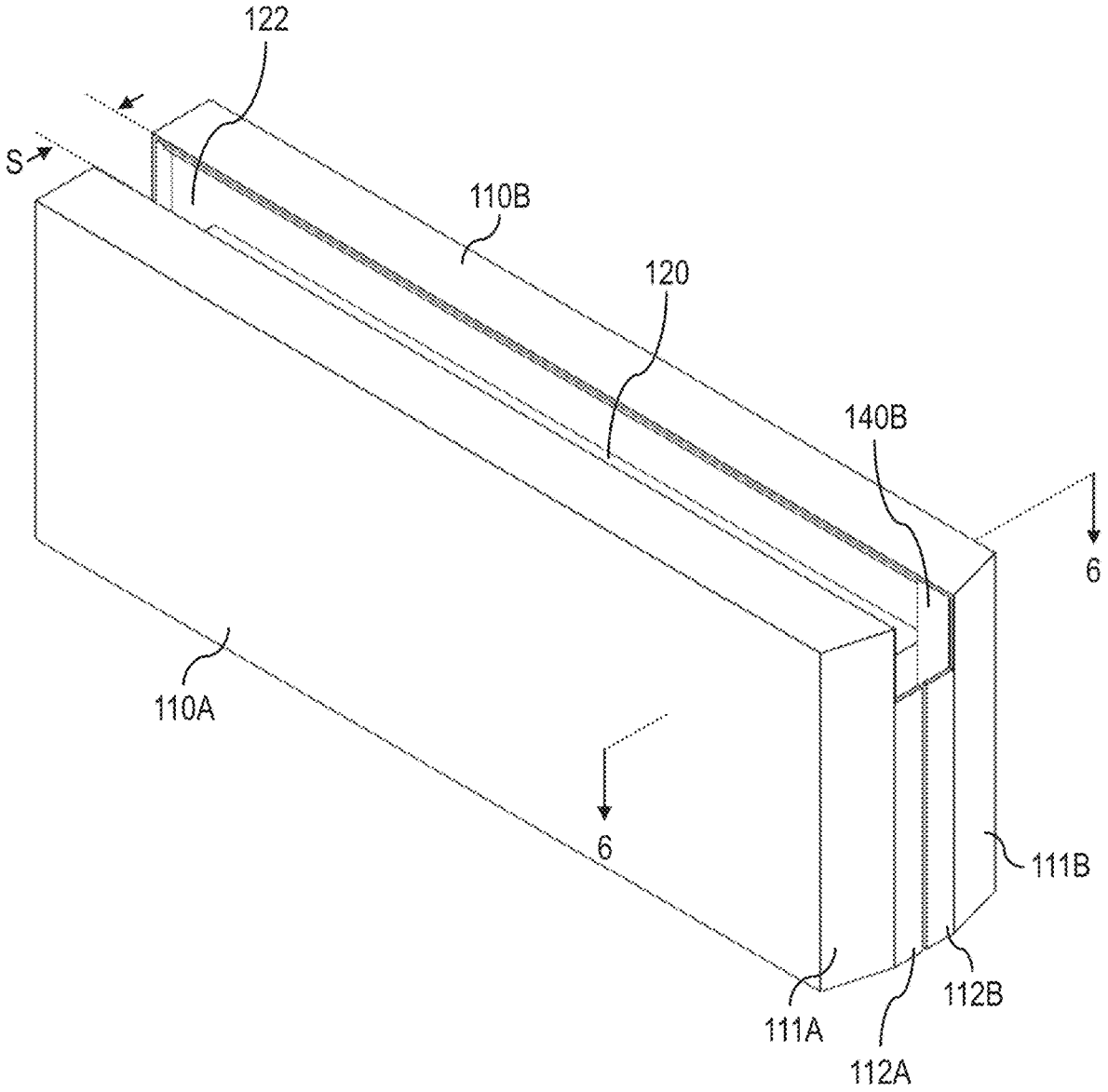
FIG. 3 is a perspective top view of one embodiment of the assembled patch fitting.

FIG. 3 depicts coverplates 110A, 110B installed on a patch fitting 120 with buffers 140A (not visible), 140B. In some embodiments, when the coverplates are installed, the spacing between the coverplates S may be equivalent to the width W of the channel 122. In this way, the glass door pane 10 may be suitably immobilized between the patch fitting 10 and the coverplates 110A, 110B.

As depicted in FIG. 3, coverplates 110A, 110B may include tapered edges 111A, 111B and leading edges 112A, 112B. The tapered edges 111A, 111B may cover a back edge of the glass door pane 10. In these embodiments, the tapered edges 111A, 111B may be situated between the proximal portion of the door frame 1A and the glass door pane 10. In some embodiments, as shown in FIG. 3, the leading edges 112A, 112B may extend from the tapered edges 111A, 111B in the direction towards the glass door pane. The leading edges 112A, 112B may provide aesthetic benefits of capping the portion of the patch fitting 120 closest to the proximal portion of the door frame 1A. The leading edges 112A, 112B may only be present on one end of the patch fitting 120, where the glass door pane 10 is closest to the proximal portion of the door frame 1A. The tapered edges 111A, 111B and the leading edges 112A, 112B may be different heights, which may allow the glass door pane 10 to extend out beyond the patch fitting assembly 100, closer to the proximal portion of the door frame 1, as discussed below.

Figure 4A:
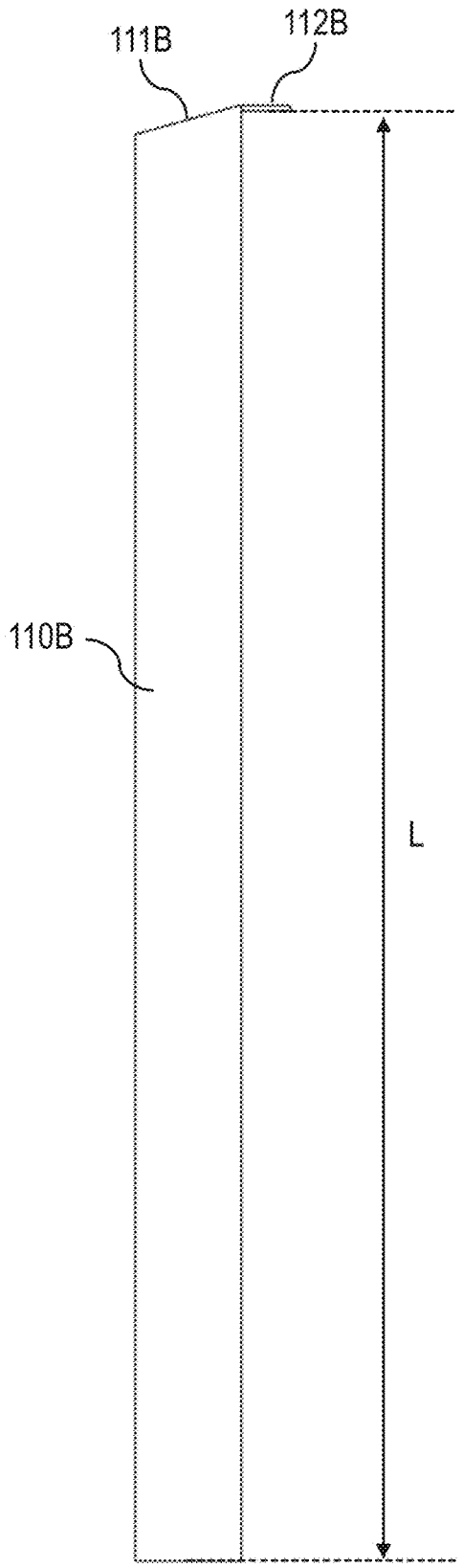
FIG. 4A is a top view of one embodiment of a coverplate of the patch fitting.

FIG. 4A is a top view of a coverplate 110B, with tapered edge 111B and leading edge 112B. In all embodiments, the length L of the coverplates 110A, 110B is measured from the leading edge 112A, 112B to the opposite side of the coverplates 110A, 110B. In embodiments where the coverplates 110A, 110B extend the pivot point centerline of a patch fitting 120, the length L of the coverplates 110A, 110B may be between 7 and 8 inches, for example 7.5 inches, as depicted in FIG. 4A.

Figure 4B:
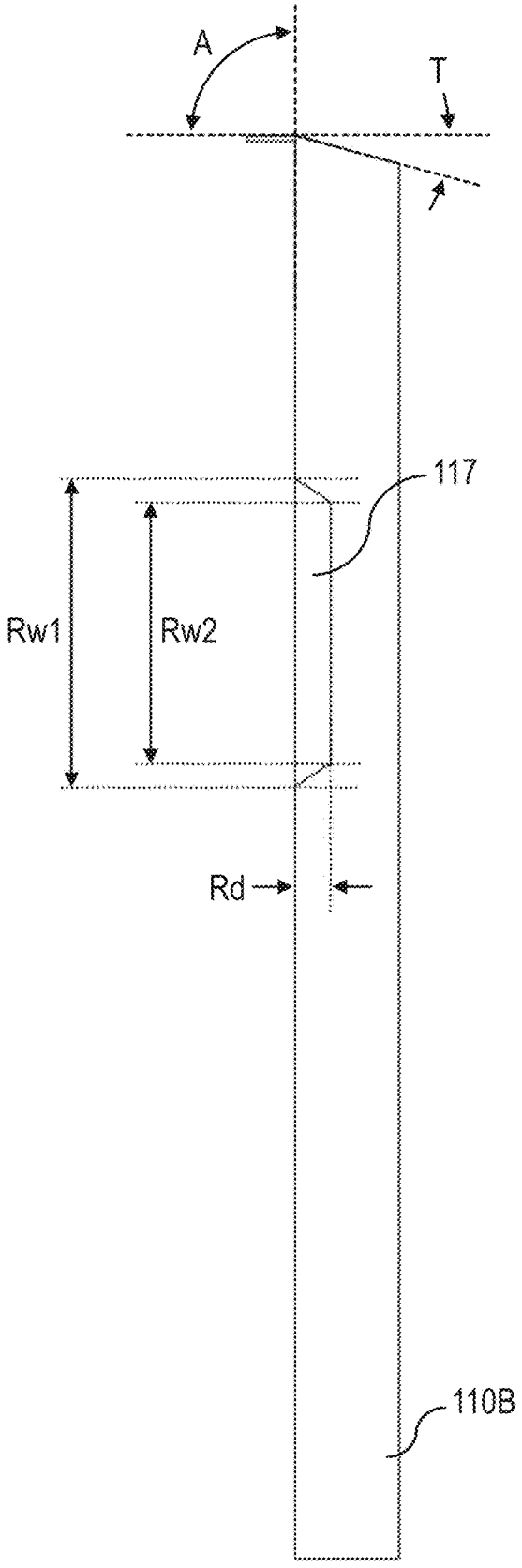
FIG. 4B is a bottom view of the coverplate from FIG. 4A.

FIG. 4B is a bottom view of a coverplate 110B, with tapered edge 111B and leading edge 112B. The tapered edge 111B may enable smooth actuation of the glass door and potentially prevent collisions between the patch fitting assembly 100 and the glass door pane 10 when the glass door pane 10 is actuated. The tapered edge 111B may be characterized by a taper angle T, measured between the plane of the tapered edge 111B and a plane normal to the glass door pane 10. In some embodiments, the taper angle T may be between 12° and 16°, for example 15.6°. Although the tapered edge 111B shown in FIG. 4B is linear, a substantially curved tapered edge may also be suitable, as the present disclosure is not so limited.

In some embodiments, the leading edge 112B may be orthogonal to the coverplate 110B face, as shown in FIG. 4B, such that a lead angle A measured between the plane of the coverplate 110B and the plane of the leading edge 112B may be 90°. In other embodiments, it may be preferable for the leading edge 112B to be tapered akin to the tapered edge 111B for aesthetic purposes or to maximize the clearance between the patch fitting assembly 100 and the glass door pane 10.

Furthermore, as seen in FIG. 4B, bottom face of the coverplate 110B may include a recess 117 to accommodate the spindle 125 of the patch fitting 120. The recess 117 may be suitably sized to allow the spindle 125 to engage with the floor plate 130 without limiting the functionality of the spindle 125. In some embodiments, the recess 117 may be larger than the spindle 125 to allow variable adjustment of the spindle location with respect to the coverplates 110A, 110B. As shown in FIG. 4B, the recess 117 may be measured by a recess depth Rd, measured as the distance the recess 117 extends normal to the plane of the coverplate 110B face, a recess width Rw1, measured as the distance between the edges of the recess 117 at the plane of the glass door 10, and a recess inner width Rw2, measured as the distance between the edges of the recess 117 at the recess depth Rd. In some embodiments, the recess inner width Rw2 may be the same size as the recess width Rw1. In other embodiments, as shown in FIG. 4B, it may be suitable for the recess 117 to include a taper between the recess inner width Rw2 and the recess width Rw1 for relief of stress concentrations. The recess 117 may be arranged with any suitable shape to accept the spindle 325, including a semi-ellipse or a semi-octagon, as the current disclosure is not so limited. In embodiments where the coverplates 110A, 110B are a pair of mirrored coverplates 110A, 110B, the recess 117 may also be mirrored on each of the pair of mirrored coverplates 110A, 110B. In some embodiments, the recess depth Rd may be between 1/10 and 3/10 inch, for example 3/16 inch. In some embodiments, the recess width Rw1 may be between 1 and 2 inches, for example 1⅝ inches. In some embodiments, the recess inner width Rw2 may be between 1 and 2 inches, for example 1⅜ inches.

Figure 5A:
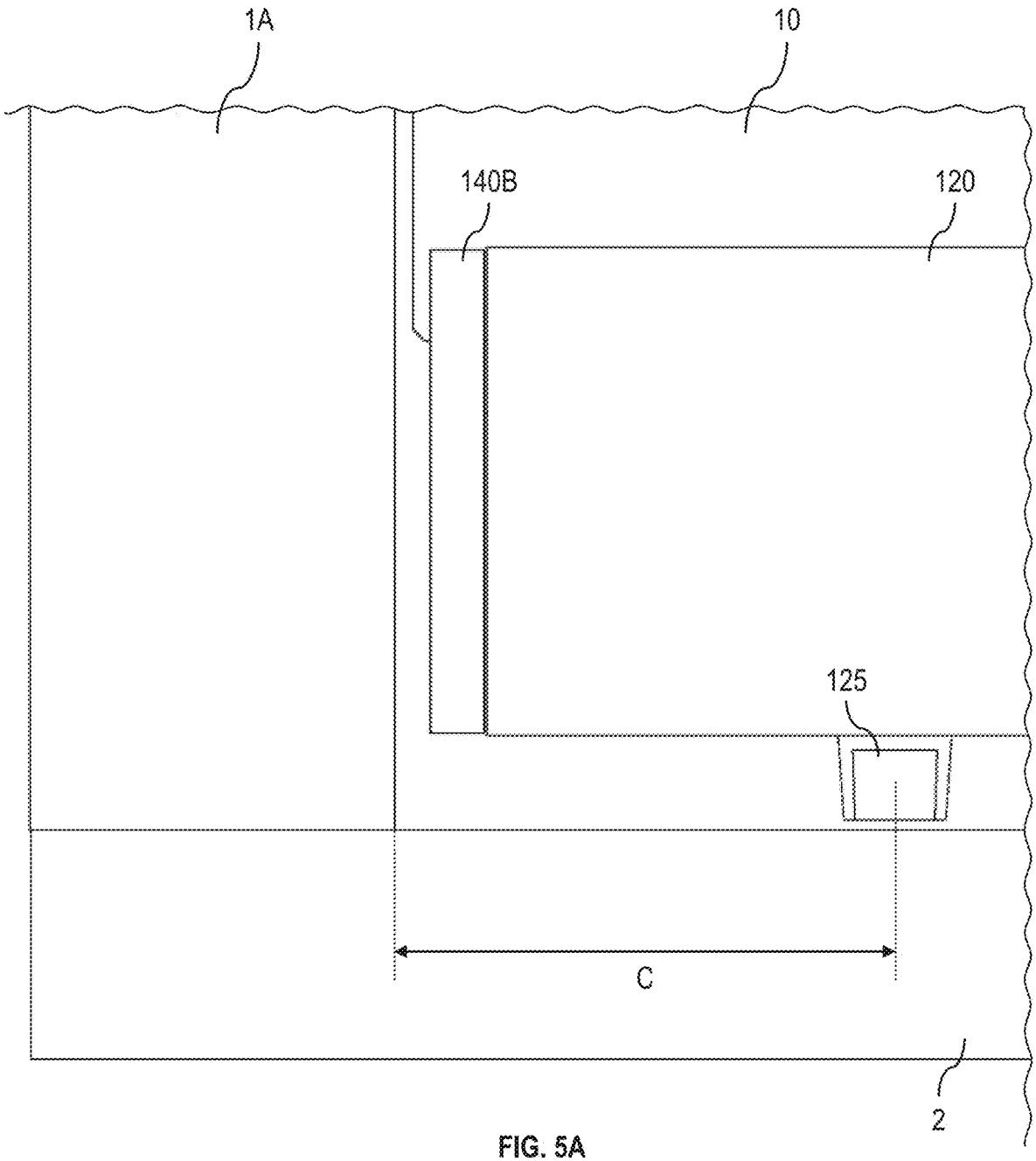
FIG. 5A is a side view of one embodiment of a patch fitting installed on a glass door pane.

As noted above, embodiments of the coverplate disclosed herein may be fit over a patch fitting so as to modify the pivot point centerline between the patch fitting and a proximal portion of the door frame, without requiring any changes to the patch fitting geometry. The coverplate may act to retrofit existing patch fittings with any pivot point centerline to interact with glass door panes and floor plates of any other standard pivot point centerline. As such, the coverplates 110A, 110B may include an added functionality of changing the pivot point centerline C of the patch fitting assembly 100. As shown in FIG. 5A, the pivot point centerline C is measured as the distance between the central axis of the spindle 125 of the patch fitting 120 and the proximal portion of the door frame 1A. FIG. 5A is a side view of the patch fitting assembly 100 installed on a glass door pane 10, floor 2, and proximal portion of the door frame 1A. The coverplates 110A, 110B and the floor plate 130 are not included in FIG. 5A for clarity.

In some embodiments, the coverplates 110A, 110B may extend the patch fitting 120 in a direction toward the portion of the proximal portion of the door frame 1A. In some embodiments, it may be suitable for the coverplates 110A, 110B to extend the pivot point centerline C to a distance between 2 9/16 inches and 2¾ inches, for example 2¾ inches. As seen in FIG. 5A, the buffers 110A (not visible), 110B may fit the space between the patch fitting 120 and the coverplates 110A, 110B when the coverplates extend the pivot point centerline C of the patch fitting assembly 100.

Figure 5B:
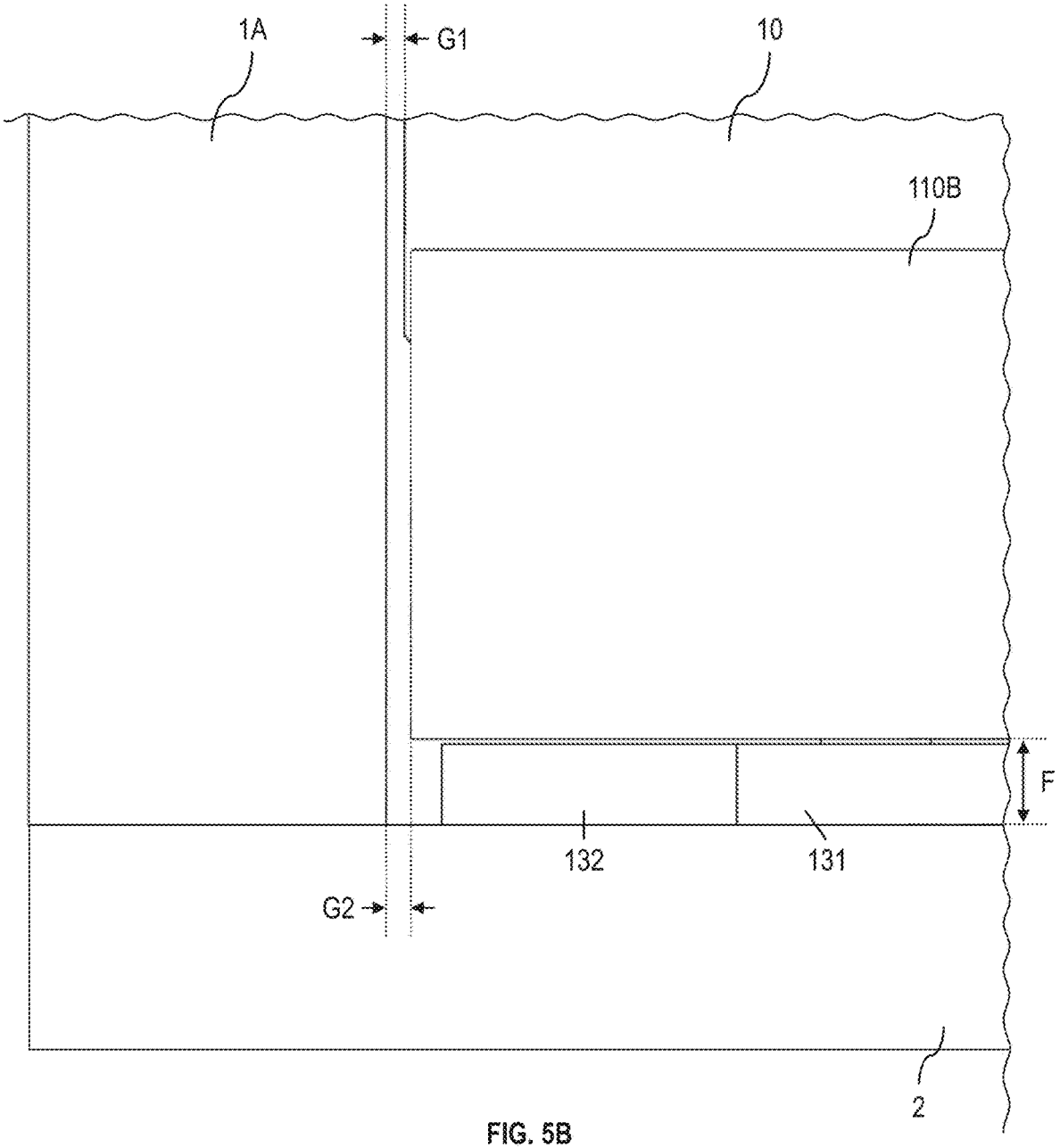
FIG. 5B is a side view of a coverplate installed on the patch fitting from FIG. 5A.

FIG. 5B depicts a side view of an embodiment of the patch fitting assembly 100 installed on a glass door pane 10, a floor 2, and nearby the proximal portion of the door frame 1A. In some embodiments, such as the one depicted in FIG. 5B, the glass door pane 10 and the proximal portion of the door frame 1A may be separated by a first gap G1 when the glass door pane 10 is installed in a patch fitting assembly 100. The first gap G1 may be suitably arranged to allow smooth operation of the glass door without impinging of the glass door pane 10 and the proximal portion of the door frame 1A. In embodiments where the coverplates 110A, 110B extend the pivot point centerline C of the patch fitting 120 from 2 9/16 inches to 2¾ inches, the first gap G1 may be ⅛ inch.

In some embodiments, such as the one depicted in FIG. 5B, the leading edge 112A, 112B of the coverplates 110A, 110B and the proximal portion of the door frame 1A may be separated by a second gap G2 when the glass door pane 10 is installed in a patch fitting assembly 100. In some embodiments, the second gap G2 may be larger than the first gap G1. In these embodiments, the difference in height between the tapered edges 111A, 111B and the leading edges 112A, 112B of the coverplates may allow the glass pane 10 to extend out beyond the patch fitting assembly 100, closer to the proximal portion of the door frame 1A, as depicted in FIG. 5B. In embodiments where the coverplates 110A, 110B extend the pivot point centerline C of the patch fitting 120 from 2 9/16 inches to 2¾ inches, the second gap G2 may be 13/32 inch.

Figure 1B:
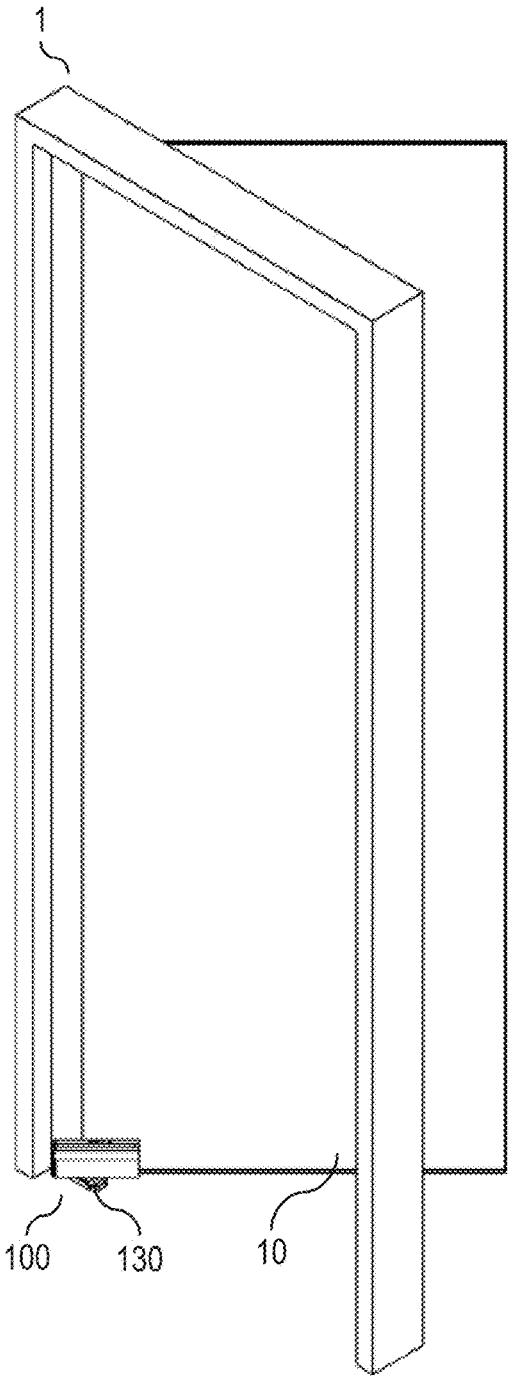
FIG. 1B is a perspective top view of another embodiment of a patch fitting assembly installed on a glass door.

As shown in FIGS. 1B and 2, in some embodiments, the floor plate 130 may be shorter than the patch fitting 120 in the direction parallel to the floor. In these embodiments, there may be a portion of the patch fitting 120, and a substantial portion of the glass door pane 10 edge, that may be suspended and offset from the floor 2 by an offset distance F. As shown in FIG. 5B, the offset distance F may be measured between the bottom edge of the coverplates 110A, 110B and the floor 2. In some embodiments, the offset distance F may be between ¼ and ¾ inch, for example 15/32 inch.

Figure 6A:
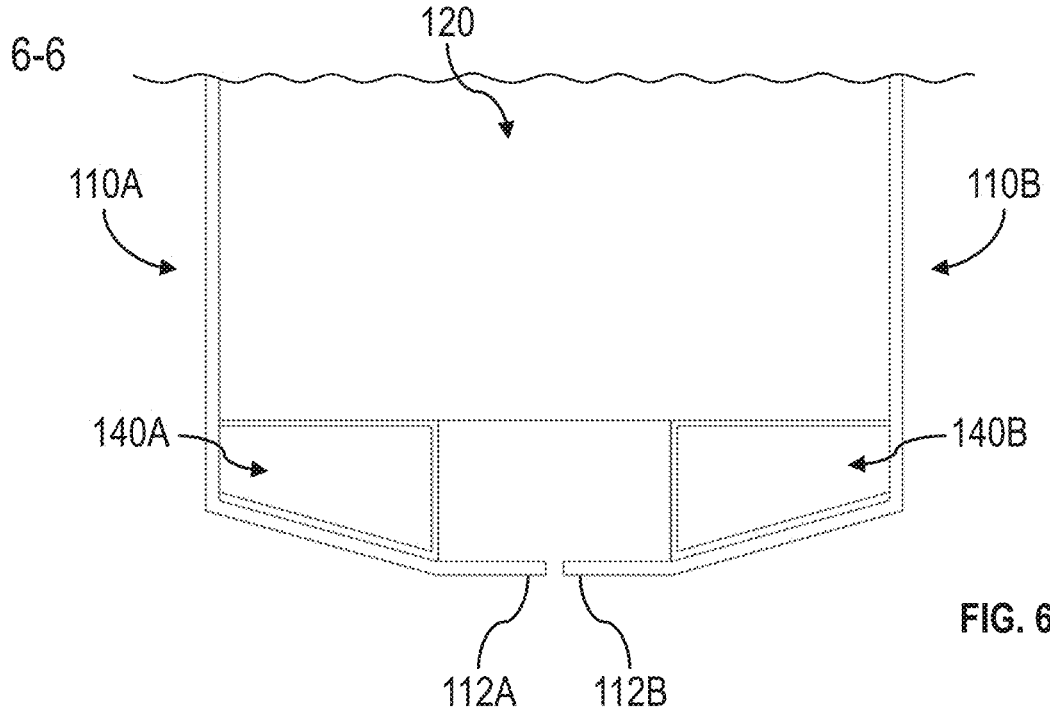
FIG. 6A is a top view of a pair of coverplates, a patch fitting, and buffers taken along line 6-6 of FIG. 3.

FIG. 6A depicts a top view taken along line 6-6 of FIG. 3, of the patch fitting 120 assembled with coverplates 110A, 110B and buffers 140A, 140B. The glass door pane 10 has been omitted from this view for clarity. The buffers may be disposed on an interior portion of the coverplates 110A, 110B between the glass door pane 10 and the patch fitting 120. In embodiments where the coverplates 110A, 110B extend beyond the patch fitting 120, as seen in FIG. 6A, the buffers 140A, 140B may be disposed on an interior portion of the coverplates 110A, 110B. In some embodiments, the buffers 140A, 140B may separate the coverplates 110A, 110B from the glass door pane 10 to avoid undesirable contact or potential damage. In some embodiments, the buffers 140A, 140B may be arranged to enhance the friction between multiple surfaces. In these embodiments, the buffers 140A, 140B may be composed of a friction-enhancing material (e.g., rubber, silicone, cork, cellulose-based composites). In some embodiments, the buffers 140A, 140B may provide rigid structural support to the portions of the coverplates 110A, 110B extending beyond the patch fitting 120.

Figure 6B:
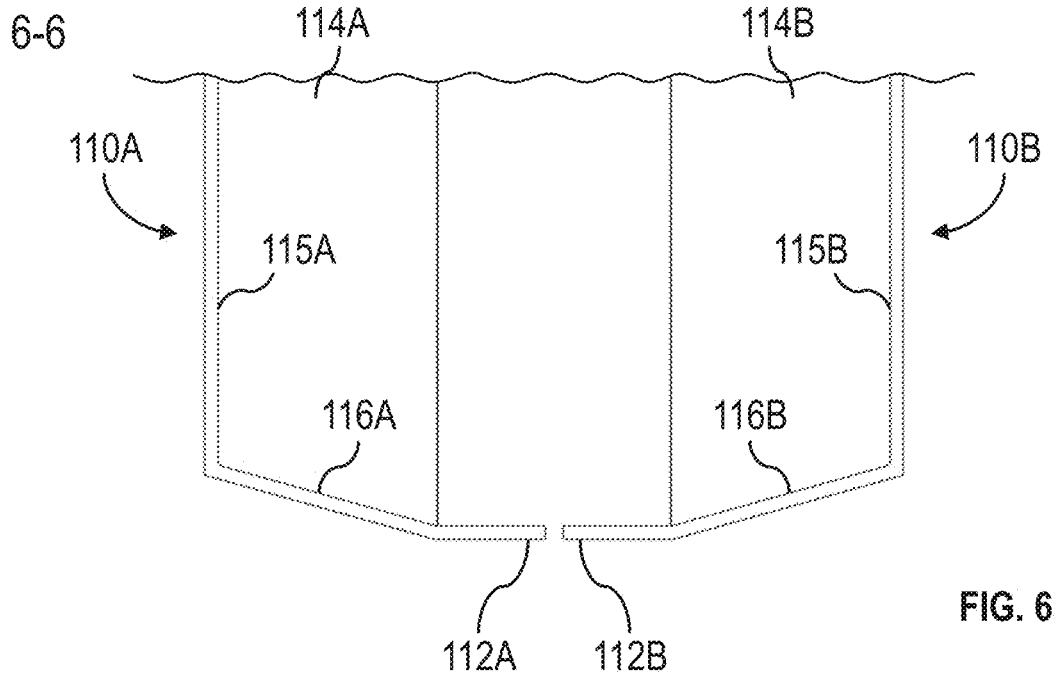
FIG. 6B is a top view of the pair of coverplates from FIG. 6A with the buffers removed for clarity.
Figure 6C:
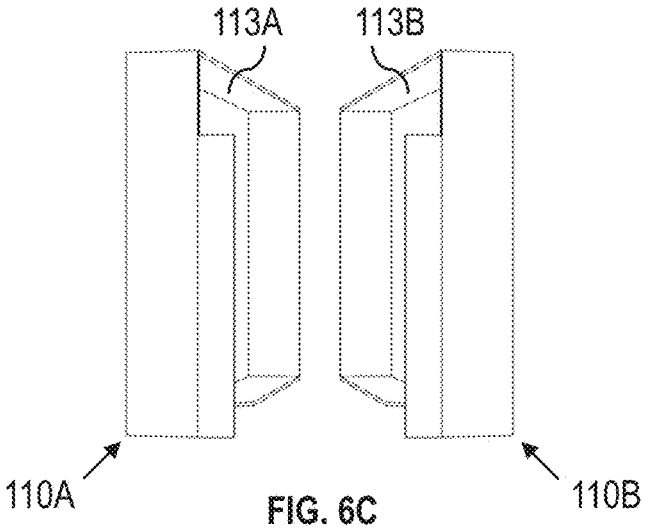
FIG. 6C is a perspective front view of the pair of coverplates from FIG. 6A.
Figure 7A:
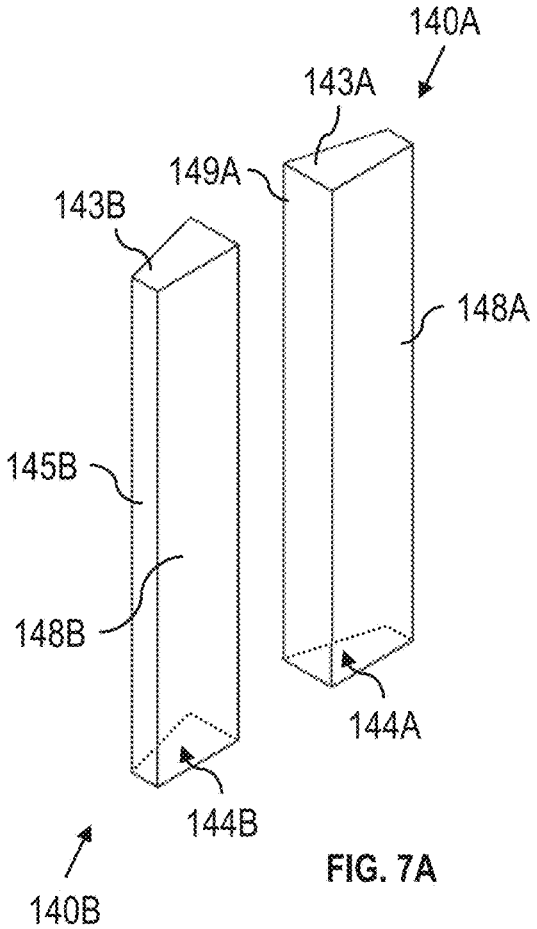
FIG. 7A-7B are rear and front perspective top views, respectively, of a pair of buffers.
Figure 7B:
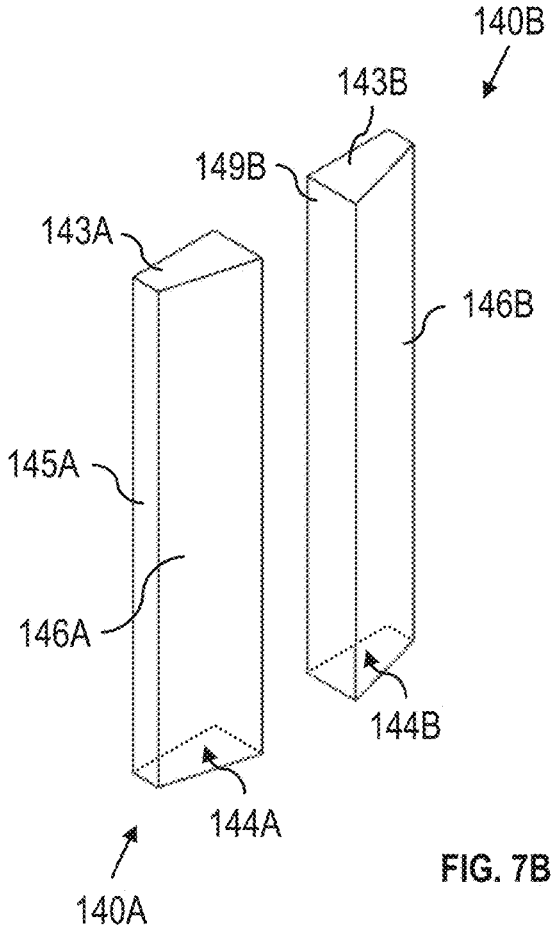

In some embodiments, as shown in FIG. 6B taken along line 6-6 of FIG. 3, coverplate 110A may include surfaces 114A, disposed at the bottom portion of the coverplate 110A, 115A, disposed on the side portion of the coverplate 110A, and 116A, disposed on the interior of the tapered edge 111A of the coverplate 110A. Similarly, coverplate 110B may include surfaces 114B, disposed at the bottom portion of the coverplate 110B, 115B, disposed on the side portion of the coverplate 110B, and 116B, disposed on the interior of the tapered edge 111B of the coverplate 110B. In some embodiments, as shown in the perspective view of FIG. 6C, the coverplates 110A, 110B may include surfaces 113A, 113B, disposed on the interior upper portion of the coverplates 110A, 110B.

As shown in FIGS. 6A and 6B, both perspective top views of the buffers 140A, 140B, each buffer may include multiple faces. In some embodiments, every face of the buffers 140A, 140B may interface with a surface of either the patch fitting 120, the coverplates 110A, 110B, or the glass door pane 10. Accordingly, the buffers may frictionally couple the patch fitting 120, the coverplates 110A, 110B, and the glass door pane 10.

In some embodiments, faces 143A, 143B of the buffers 140A, 140B may be in contact with the surfaces 113A, 113B of the coverplates 110A, 110B. In some embodiments, faces 144A, 144B of the buffers 140A, 140B may be in contact with the surfaces 114A, 114B of the coverplates 110A, 110B. In some embodiments, faces 145A, 145B of the buffers 140A, 140B may be in contact with the surfaces 115A, 115B of the coverplates 110A, 110B. In some embodiments, faces 146A, 146B of the buffers 140A, 140B may be in contact with the surfaces 116A, 116B of the coverplates 110A, 110B. In some embodiments, faces 149A, 149B of the buffers 140A, 140B may be in contact with opposing sides of the glass door pane 10. In some embodiments, faces 148A, 148B of the buffers 140A, 140B may be in contact with the surface 128 of the patch fitting 120, as shown in FIG. 2. In some embodiments, the buffers 140A, 140B may only include a portion of the contact pairs depicted in FIGS. 2, 6A-6C, and 7A-7B.

In some embodiments, the pair of buffers 140A, 140B may be mirrored akin to an embodiment of the mirrored coverplates 110A, 110B. In other embodiments, a pair of mirrored buffers 140A, 140B may interface with a pair of non-mirrored coverplates 110A, 110B, a pair of non-mirrored buffers 140A, 140B may interface with a pair of mirrored coverplates 110A, 110B, or any other suitable combination as the present disclosure is not so limited.

The coverplates 110A, 110B may be composed of a material for rigidity and/or to minimize long-term wear. For some applications, it may be desirable to coat the coverplates 110A, 110B with a material for various reasons. For example, and without limitations, the coating may produce a desired finish, protect the finish of patch fitting assembly 100, enhance friction, and/or provide an anti-microbial layer.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Thus, it should also be appreciated that features described herein as being part of one or more embodiments may be combined with or removed from other embodiments, as the present disclosure invention is not limited to any particular embodiment having any particular feature. Accordingly, the foregoing description and drawings are by way of example only.

What is claimed is:

1. A patch fitting coverplate for a pre-existing patch fitting, the pre-existing patch fitting operatively couplable to a door pane and a pre-existing coverplate having leading edge spaced away from a spindle extending from the pre-existing patch fitting by a first distance, the patch fitting coverplate comprising:

one or more buffers cooperating with a body, and the body constructed and arranged to cover an external portion of the pre-existing patch fitting, wherein the body comprises:

a tapered edge tapered relative to a horizontal axis of the door pane when the door pane is coupled to the pre-existing patch fitting; and a leading edge extending from the tapered edge in a direction towards a midplane of the door pane when the door pane is coupled to the pre-existing patch fitting, wherein the leading edge of the body is configured to be spaced away from the spindle extending from the pre-existing patch fitting by a second distance, wherein the second distance is greater than the first distance, and wherein the body is operatively couplable to the pre-existing door patch through a friction fitting with the one or more buffers.

2. The patch fitting coverplate of claim 1, wherein the patch fitting coverplate is removably attached to the patch fitting.

3. The patch fitting coverplate of claim 1, wherein the tapered edge is tapered at 15.6° relative to a horizontal axis of the door pane when the door pane is coupled to the pre-existing patch fitting.

4. The patch fitting coverplate of claim 1, wherein the leading edge of the body is substantially orthogonal relative to the door pane when the door pane is coupled to the pre-existing patch fitting.

5. The patch fitting coverplate of claim 1, wherein the leading edge of the body is shorter than the tapered edge relative to a vertical axis of the door pane when the door pane is coupled to the pre-existing patch fitting.

6. The patch fitting coverplate of claim 1, wherein the leading edge of the body is configured to be orthogonal to the body.

7. The patch fitting coverplate of claim 1, wherein the one or more buffers are constructed of a friction enhancing material.

8. The patch fitting coverplate of claim 1, wherein the one or more buffers are constructed of a shock-absorbing material.

9. The patch fitting coverplate of claim 1, wherein the one or more buffers are disposed between the pre-existing patch fitting, the door pane, and an interior portion of the patch fitting coverplate when the door pane is coupled to the pre-existing patch fitting.

* * * * *